US012662223B1

(12) United States Patent
Gordon et al.

(10) Patent No.: US 12,662,223 B1
(45) Date of Patent: Jun. 23, 2026

(54) UNMANNED UNDERWATER VEHICLE

(71) Applicant: The United States of America, as represented by the Secretary of the Navy, Arlington, VA (US)

(72) Inventors: Benjamin Gordon, Rockville, MD (US); Jennifer Nunes, Cabin John, MD (US); Isaac Downey, Middleton, MD (US); Joseph Buto, Columbia, MD (US); John Phillips, Virginia Beach, VA (US)

(73) Assignee: The United States of America, represented by the Secretary of the Navy, Washington, DC (US)

( * ) Notice: Subject to any disclaimer, the term of this patent is extended or adjusted under 35 U.S.C. 154(b) by 555 days.

(21) Appl. No.: 18/335,410

(22) Filed: Jun. 15, 2023

(51) Int. Cl.
*B63G 8/08* (2006.01)
*B63G 8/00* (2006.01)
*B63G 8/16* (2006.01)

(52) U.S. Cl.
CPC ..... *B63G 8/08* (2013.01); *B63G 8/001* (2013.01); *B63G 8/16* (2013.01); *B63G 2008/002* (2013.01)

(58) Field of Classification Search
CPC . B63G 8/08; B63G 8/001; B63G 8/16; B63G 2008/002; B63B 43/08
See application file for complete search history.

(56) References Cited

U.S. PATENT DOCUMENTS 8,418,642 B2 4/2013 Vosburgh
2012/0289103 A1 11/2012 Hudson
2014/0202367 A1* 7/2014 Dollar ..... B63B 43/08 114/124
2017/0036746 A1* 2/2017 MacCready ..... B63G 8/16
2017/0369137 A1* 12/2017 Smith ..... G05D 1/0875
2019/0256181 A1 8/2019 Valsvik

FOREIGN PATENT DOCUMENTS

CN 108698677 B 6/2021
KR 20160015935 A 2/2016

OTHER PUBLICATIONS

Benedetto Piaggio 1, Giuliano Vernengo, Marco Ferrando, Giorgio Mazzarello, and Michele Viviani, "Submarine Manoeuvrability Design: Traditional Cross-Plane vs. x-Plane Configurations in Intact and Degraded Conditions," J. Mar. Sci. Eng. 2022, 10, 201.

* cited by examiner

*Primary Examiner* — Andrew Polay
(74) *Attorney, Agent, or Firm* — Jesus J. Hernandez; U.S. Department of the Navy, Office of the General Counsel

(57) ABSTRACT

Example embodiments provide a propulsion system apparatus, an underwater apparatus comprising a propulsion system, and a method for propelling underwater. According to an example embodiment, a propulsion system may comprise a movable weight unit configured to control pitch by shifting weight along a first axis to move center of gravity along the first axis, and a thruster unit fixed at a non-zero angle relative to the first axis and configured to provide thrust along the first axis and further control the pitch alongside the movable weight unit. The thruster unit may be further configured to provide differential thrust to control yaw along a second axis.

16 Claims, 9 Drawing Sheets

900

UNMANNED UNDERWATER VEHICLE

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to underwater vehicles.

BACKGROUND

Most small underwater vehicles employ a ballasting system with a fixed weight. This forces underwater vehicles to have a static pitch angle unless the underwater vehicle is opened to facilitate adjustment of the fixed weight, Fixed configurations do not allow such underwater vehicles to adapt to multiple water environments.

Additionally, most control systems of underwater vehicles incorporate a fixed thruster with movable control surfaces for steering. Such underwater vehicle require an exterior envelope outside the parallel mid body of the vehicle. The moving parts and exterior envelope configuration complicates storage and launch of such underwater vehicles.

SUMMARY

Example embodiments provide a propulsion system apparatus, an underwater apparatus comprising a propulsion system, and a method for propelling underwater. According to an example embodiment, a propulsion system may comprise a movable weight unit configured to control pitch by shifting weight along a first axis to move center of gravity along the first axis, and a thruster unit fixed at a non-zero angle relative to the first axis and configured to provide thrust along the first axis and further control the pitch alongside the movable weight unit. The thruster unit may be further configured to provide differential thrust to control yaw along a second axis.

BRIEF DESCRIPTION OF DRAWINGS

The accompanying figures are included to provide a further understanding of example embodiments, and are incorporated in and constitute part of this specification. In the figures.

DETAILED DESCRIPTION

In the following description, for purposes of explanation and not limitation, specific details are set forth such as particular structures, designs, techniques, etc., in order to provide a thorough understanding of the example embodiments. However, it will be apparent to those skilled in the art that the disclosed subject matter may be practiced in other illustrative embodiments that depart from these specific details. In some instances, detailed descriptions of well-known elements and/or method are omitted so as not to obscure the description with unnecessary detail. All principles, aspects, and embodiments, as well as specific examples thereof, are intended to encompass both structural and functional equivalents of the disclosed subject matter. Additionally, it is intended that such equivalents include both currently known equivalents as well as equivalents developed in the future.

The following description refers to an unmanned underwater vehicle and its method of use. However, it should be noted that the example embodiments shown and described herein are meant to be illustrative only and not limiting in any way. As such, various modifications will be apparent to those skilled in the art for application to underwater vehicles based on technologies other than the above, which may be in various stages of development and intended for future replacement of, or use with, the above described method or apparatus.

Figure 1:
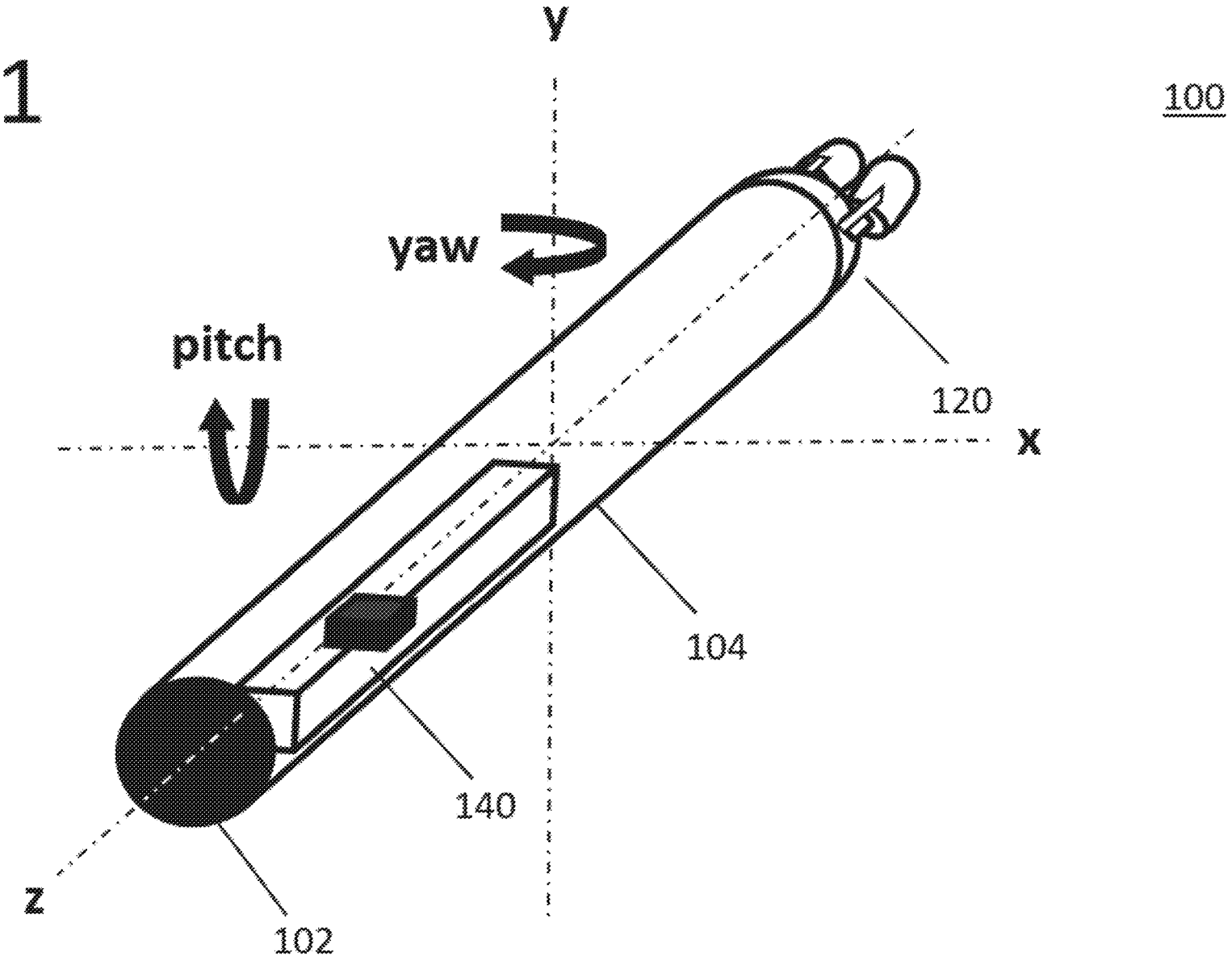
FIG. 1 is a three-dimensional diagram of an unmanned underwater vehicle according to an example embodiment.

The goal of the invention is to provide a small unmanned vehicle that may traverse surf zones and littoral areas. FIG. 1 is a three-dimensional diagram of an unmanned underwater vehicle 100 according to an example embodiment. Unmanned underwater vehicle 100 may include a nose cone 102 at the bow. The nose cone 102 is connected to the vehicle body 104. The nose cone 102 and the vehicle body 104 are configured to withstand pressures from surf zones and littoral areas. In alternative embodiments, the nose cone 102 and the vehicle body 104 may be configured to withstand pressures from dives in open water and/or deep water. In alternative embodiments, the nose cone 102 may have increase concavity such that it protrudes. In further embodiments, the nose cone 102 may include a compartment for a sensor unit, navigation unit, and/or other unit. The sensing units may include a compass, altimeter, and/or antenna.

The vehicle body 104 may be a parallel cylindrical envelope serving as a mid-body portion. The vehicle body 104 extends through the length of the unmanned underwater vehicle 100 along the z-axis in FIG. 1. The vehicle body 104 may be made of a water proof or water resistant materials, such as plastic, fiberglass, aluminum, or other comparable material.

The unmanned underwater vehicle 100 includes a propulsion system that comprises a thruster unit 120 and a movable ballast weight unit 140. The thruster unit 120 is located at the stern of the vehicle body 104. The thruster unit 120 may include two thrusters, each with a propeller. Each thruster in the thruster unit 120 is stationary and angled. More specifically, each thruster is angled and fixed with respect to the azimuth. In other words, each thruster is angled slightly toward the centerline of the unmanned underwater vehicle 100. In such a configuration, the thruster unit 120 may control the yaw of the unmanned underwater vehicle 100 in the x-z plane, along the y-axis.

The movable ballast weight unit 140 may be located along the centerline of the unmanned underwater vehicle 100. The movable ballast weight unit 140 controls the pitch of the unmanned underwater vehicle 100 in the y-z plane, along the x-axis. In addition, each thruster is also angled with respect to elevation. In other words, each thruster is angled toward the surface from the z-axis. In such a configuration, the thruster unit 120 may also control the pitch of the unmanned underwater vehicle 100 alongside the movable ballast weight unit 140.

The movable ballast weight unit 140 may be located between the midship and the bow along the z-axis of the unmanned underwater vehicle 100. In alternative embodiments, the movable ballast weight unit 140 may be located between midship and the stern along the z-axis of the unmanned underwater vehicle 100. In yet additional alternative embodiments, the movable ballast weight unit 140 may be located at midship.

The movable ballast weight unit 140 includes a movable weight which allows the unmanned underwater vehicle 100 to alter its pitch attitude while in the water. In an example embodiment, moving the movable weight in the forward direction results in a negative pitch angle in the y-z plane, along the x-axis. Moving the movable weight in the aft direction results in a positive pitch angle. The pitch angle may alter from zero and/or near-zero degrees to ninety and/or near-ninety degrees. In additional example embodiments, the pitch angle may reach one hundred eighty degrees. The unmanned underwater vehicle 100 may alter its attitude based on ambient conditions and/or desired goals. In alternative embodiment, the movable ballast weight unit 140 may be a fluid pump or other similar device for shifting weight along an axis.

In some example embodiments, a higher pitch of the unmanned underwater vehicle 100 may benefit communications. More specifically, a higher pitch may allow the aft of the unmanned underwater vehicle 100 to protrude when near the surface, permitting an antenna near or within the nose cone 102 to be above the surface to facilitate communications. In additional example embodiments, a high pitch can be used by the unmanned underwater vehicle 100 to dive by driving in reverse. Alternatively, low pitch may better orient various sensors depending on the configuration of the sensors within the unmanned underwater vehicle 100. A low pitch may also position the unmanned underwater vehicle 100 for more efficient forward travel.

In some example embodiments, the unmanned underwater vehicle 100 may have small dimensions to facilitate storage and launch from a larger vessel. In some example embodiments, the underwater vehicle 100 may have a diameter between 3 and 15 inches, and a length between 30 and 100 inches in length. In some example embodiments, the unmanned underwater vehicle 100 may have a 4.5 inch diameter and a 36 inch length.

Figure 2:
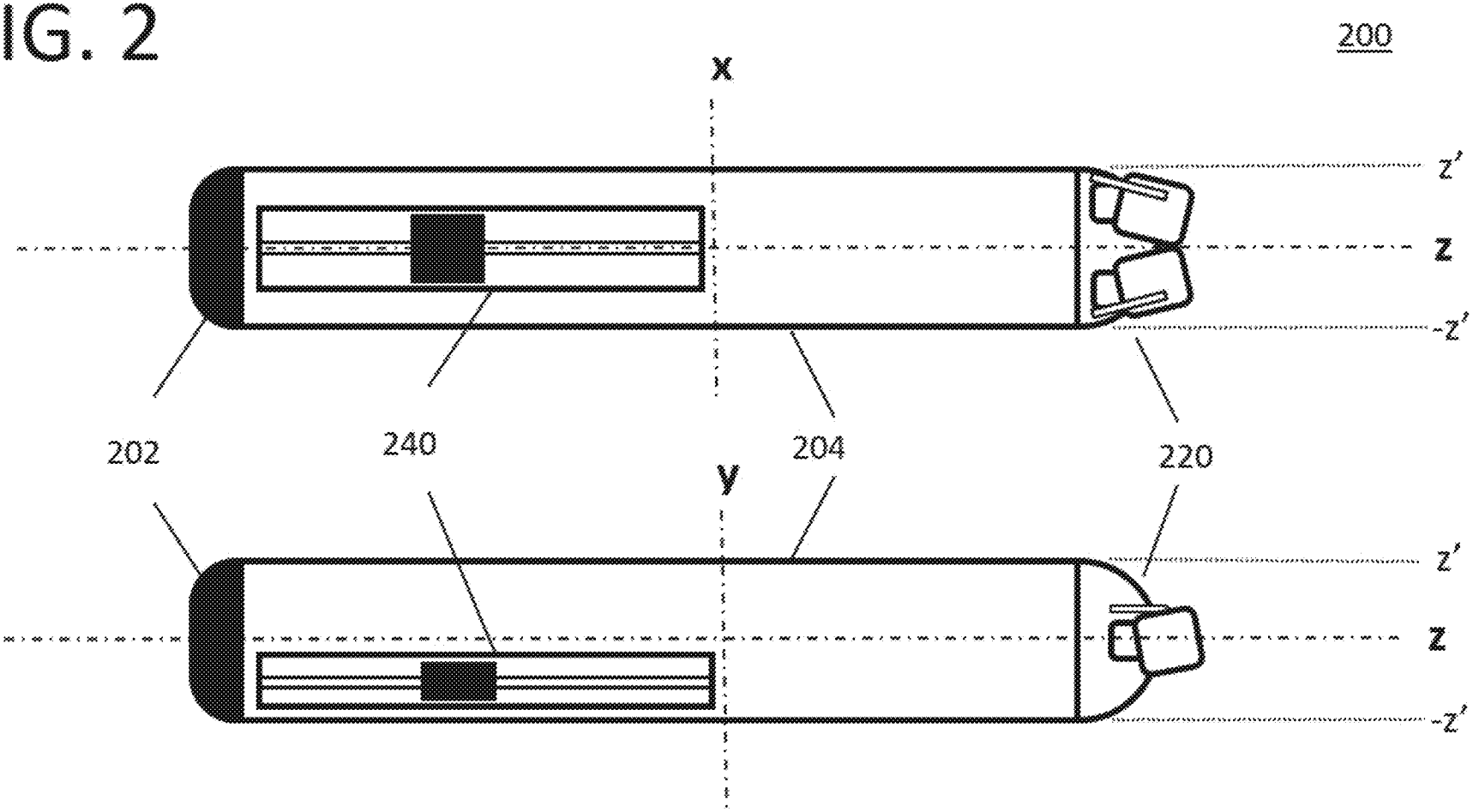
FIG. 2 is a two-dimensional diagram of an unmanned underwater vehicle along the x-z plane and γ-z plane according to an example embodiment.

FIG. 2 is a two-dimensional diagram of an unmanned underwater vehicle 200 along the x-z plane and γ-z plane according to an example embodiment. Unmanned underwater vehicle 200 may include a nose cone 202 at the bow. The nose cone 202 is connected to the vehicle body 204. The unmanned underwater vehicle 200 includes a propulsion system that comprises a thruster unit 220 and a movable ballast weight unit 240.

The movable ballast weight unit 240 may be located between midship and the bow along the z-axis of the unmanned underwater vehicle 200. The movable ballast weight unit 240 may be located along a z-axis centerline in the x-z plane of the unmanned underwater vehicle 200. The movable ballast weight unit 240 may also be located below a z-axis centerline on a y-z plane of the unmanned underwater vehicle 200. In alternative embodiments, the movable ballast weight unit 240 may be located on or above the z-axis centerline on a y-z plane of the unmanned underwater vehicle 200. In alternative embodiments, the movable ballast weight unit 240 may be located between midship and the stern of the unmanned underwater vehicle 200.

As illustrated in FIG. 2, the propulsion system is entirely within the diameter of the vehicle body 204 of the unmanned underwater vehicle 200. The unmanned underwater vehicle 200 does not have control appendages protruding outside the vehicle body 204 or outside the thruster unit 220. The entire propulsion system is within the diameter of the unmanned underwater vehicle 200, as defined by z' along the z-axis. The cylindrical shape of the vehicle body 104 facilitates storage and launch without risk of damage due to protruding components.

Figure 3:
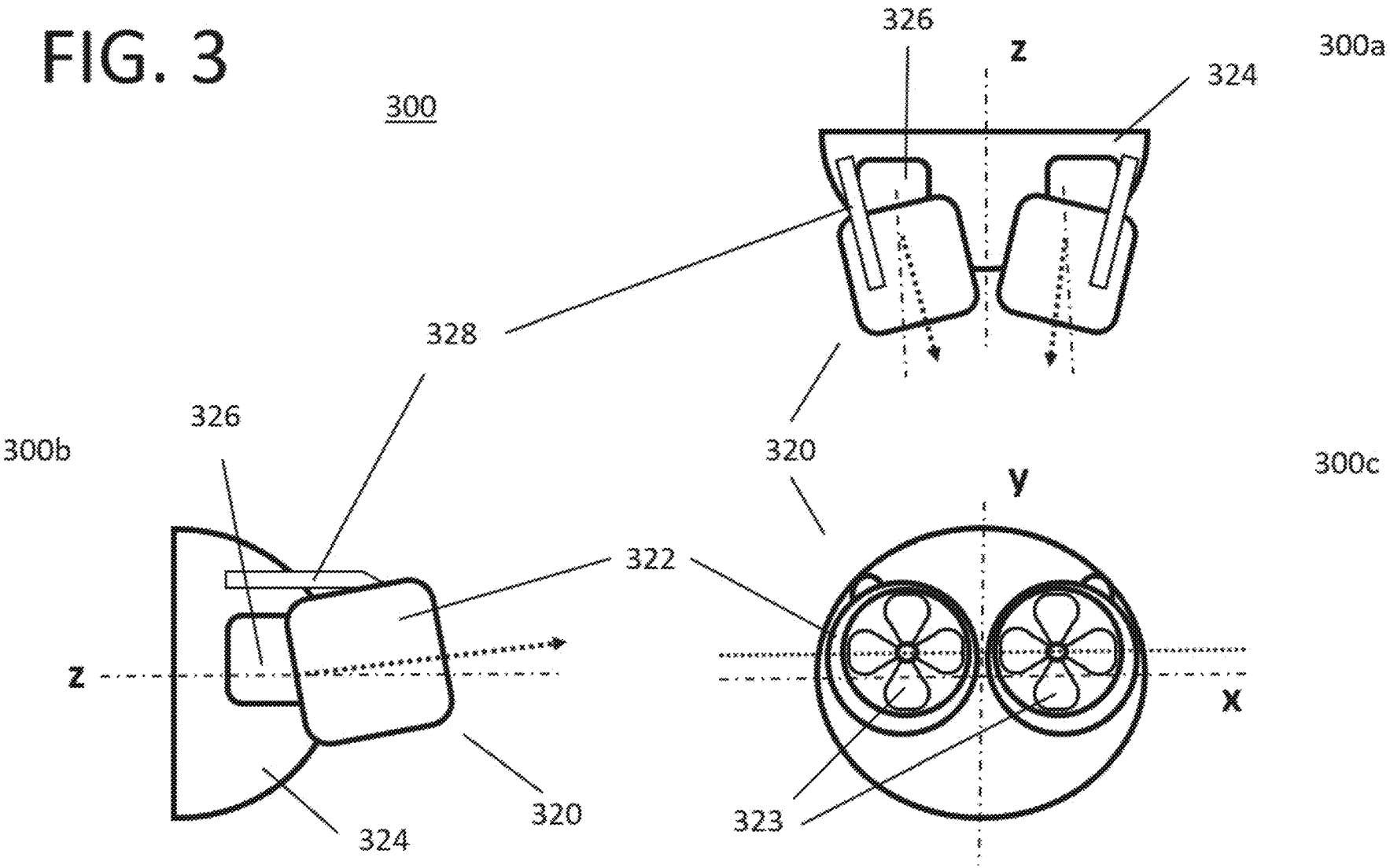
FIG. 3 is a thruster unit diagram of an unmanned underwater vehicle from multiple two-dimensional views according to an example embodiment.

FIG. 3 is a thruster unit diagram 300 of an unmanned underwater vehicle from multiple two-dimensional views according to an example embodiment. The thruster unit diagram 300 provides a two-dimensional top view 300*a* along the z-x plane, a two-dimensional side view 300*b* along the z-y plane, and a two-dimensional stern view 300*c* along the x-y plane.

The thruster unit diagram 300 depicts a thruster unit 320. The thruster unit 320 includes a thruster unit base 324 supporting two thrusters. Each thruster in the thruster unit 320 includes a propeller cover 322 housing a propeller 323. Each propeller cover 322 and propeller 323 is connected to a propeller motor shaft and cover 326. The propeller motor shaft and cover 326 is fixed to the thruster unit base 324. Further support is provided to each propeller cover 322 by a fixed support 328.

Each thruster in the thruster unit 320 is stationary and angled. As shown in the two-dimensional top view 300*a*, each thruster is angled and fixed with respect to the azimuth. In other words, each thruster is angled slightly toward the centerline of the unmanned underwater vehicle. This angle may range between zero and 45 degrees. In addition, as shown in the two-dimensional side view along the z-y plane 300*b*, each thruster is also angled with respect to elevation. In other words, each thruster is angled toward the surface. This angle may range between zero and 45 degrees. As a result, the center of the propellers 323 may be above the center of the radius of the unmanned underwater vehicle, as illustrated in the two-dimensional stern view 300*c*. In alternative embodiments, the juncture of the propeller motor shaft and cover 326 and the thruster unit base 324 may be below the center of the radius of the unmanned underwater vehicle in order to permit the center of the propellers 323 to be aligned with the center of the radius unmanned underwater vehicle.

The fixed thruster orientation prevents any moving parts and ensures that all portions are within the diameter of the vehicle body. This configuration of the thruster unit 320 increases reliability and allows steering control through differential thrust. The angled configuration also facilitates efficient hull orientation when propelling forward the unmanned underwater vehicle.

Figure 4:
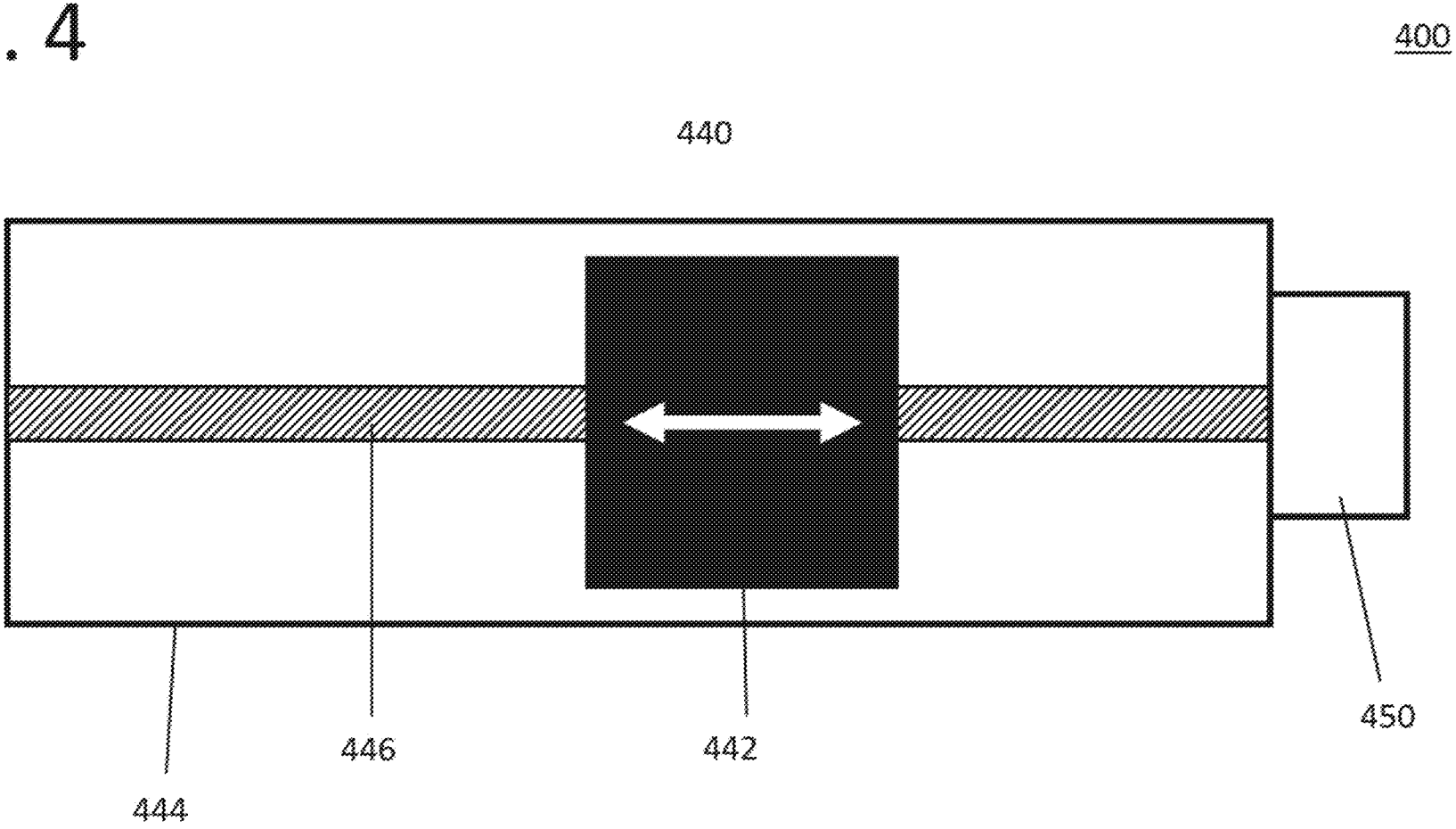
FIG. 4 is a movable ballast weight unit diagram of an unmanned underwater vehicle according to an example embodiment.

FIG. 4 is a movable ballast weight unit diagram 400 of an unmanned underwater vehicle according to an example embodiment. The movable ballast weight unit diagram 400 depicts a movable ballast weight unit 440. The length of the ballast weight cavity 444 extends along the same axis as the unmanned underwater vehicle. The ballast weight cavity 444 includes a ballast weight screw 446 that supports a ballast weight 442. The ballast weight screw 446 may rotate to facilitate movement of the ballast weight 442 along the length of the ballast cavity 444. The ballast weight unit 440 may also include a movable ballast weight unit controller 450 to control the rotation direction and rotation speed of the ballast weight screw 446.

Movement of the ballast weight 442 across the length of the ballast weight unit 440 moves the center of gravity of the unmanned underwater vehicle along the z-axis. The greater the distance of the center of gravity from the center of buoyancy of the unmanned underwater vehicle, the greater the potential pitch.

In alternative embodiment, the movable ballast weight unit 440 may be a fluid pump that moves fluids between containers at different ends of the ballast weight unit 440. In further alternative embodiments, the ballast weight screw 446 may instead be a ballast weight rod that moves the weight in a linear direction along the length of the ballast weight cavity 444.

Figure 5:
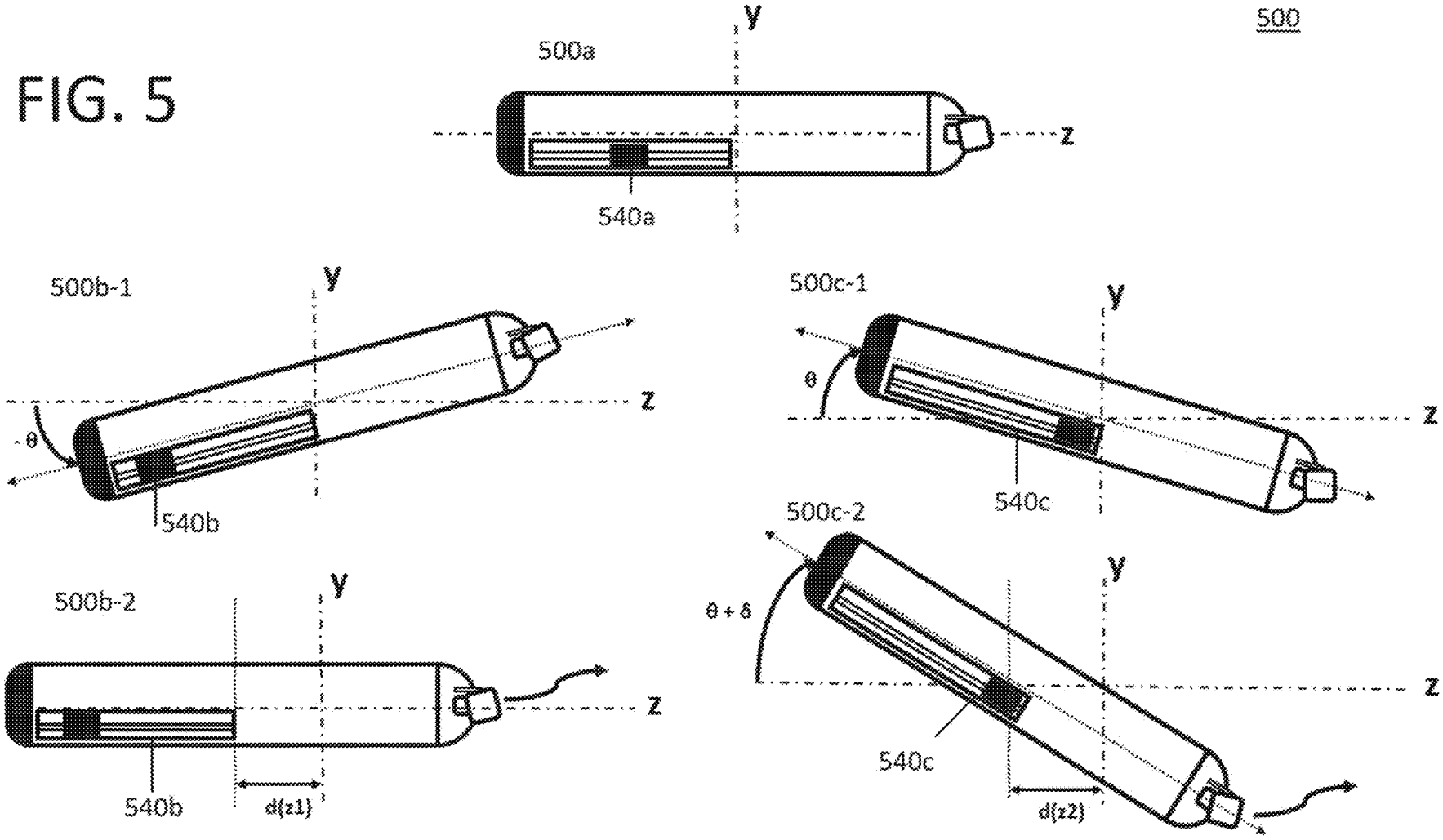
FIG. 5 is an operation of the movable ballast weight unit of an unmanned underwater vehicle according to an example embodiment.

FIG. 5 is an operation 500 of the movable ballast weight unit of an unmanned underwater vehicle according to an example embodiment. The operation 500 of the movable ballast weight controls the pitch of the unmanned underwater vehicle. The operation 500 is divided into a centered weight configuration 500*a*, a first and second forward-direction weight configurations 500*b*-1 & 500*b*-2, and a first and second aft-direction configurations 500*c*-1 & 500*c*-2.

In the centered weight configuration 500*a*, the movable ballast weight configuration 540*a* has the ballast weight in a center or near center location within the ballast weight cavity. In this configuration, the unmanned underwater vehicle is at rest and is at a zero or near-zero degree pitch.

In the first and second forward-direction weight configurations 500*b*-1 & 500*b*-2, the movable ballast weight configuration 540*b* has the ballast weight moved in a forward direction towards the bow of the unmanned underwater vehicle. This causes the unmanned underwater vehicle to have a downward pitch angle of $-\theta$. In the first forward-direction weight configuration 500*b*-1, the thruster unit is not activated.

Due to the angled configuration of the thrusters towards elevation, activation of the thruster unit generates an opposing upward pitch from the stern of the unmanned underwater vehicle. In the second forward-direction weight configuration 500*b*-2, the thruster unit is activated and has sufficient thrust to both: (i) move the unmanned underwater vehicle by a distance d(z1); and (ii) offset the $-\theta$ pitch caused by the ballast weight to bring the unmanned underwater vehicle back to a zero or near-zero pitch.

In the first and second aft-direction configuration 500*c*-1 & 500*c*-2, the movable ballast weight configuration 540*c* has the ballast weight moved towards the stern of the unmanned underwater vehicle. This causes the unmanned underwater vehicle to have an upward pitch angle of $\theta$. In the first aft-direction weight configuration 500*c*-1, the thruster unit is not activated.

Due to the angled configuration of the thrusters towards elevation, activation of the thruster unit generates an additional upward pitch from the stern of the unmanned underwater vehicle. In the second aft-direction weight configuration 500*c*-2, the thruster unit is activated to have sufficient force to both: (i) move the unmanned underwater vehicle by a distance d(z2); and (ii) augment the pitch angle $\theta$ by an additional pitch angle $\delta$.

As a result of the interplay between the movable ballast weight and the thruster unit, the pitch of the unmanned underwater vehicle may be controlled during operation or rest condition and may be altered to increase attitude and orientation.

Figure 6:
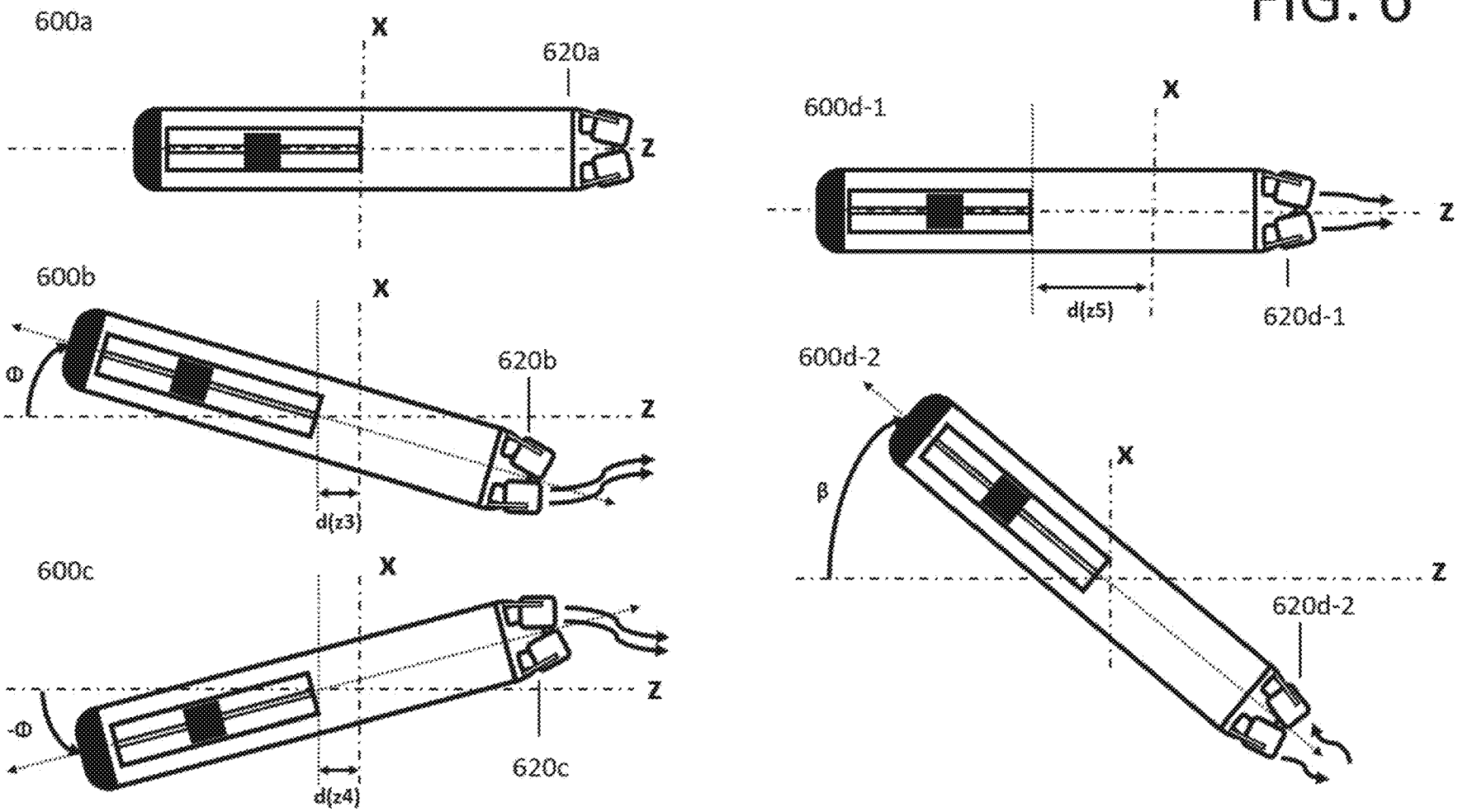
FIG. 6 is an operation of the thruster unit of an unmanned underwater vehicle according to an example embodiment

FIG. 6 is an operation 600 of the thruster unit of an unmanned underwater vehicle according to an example embodiment. The operation 600 of the thruster unit controls the yaw of the unmanned underwater vehicle. The operation 600 also highlights the differential thrust operation of the unmanned underwater vehicle. The operation 600 is divided into rest operation 600*a*, a port thruster operation 600*b*, starboard thruster operation 600*c*, and a first and second combined thruster operation 600*d*-1 & 600*d*-2. In operation 600, the movable ballast weight configuration has the ballast weight in a center or near center location for the purpose of highlighting differential thrust. In alternative operations, these ballast weight may move alongside the thrusters to impact yaw and pitch simultaneously.

In the rest operation 600*a*, the unmanned underwater vehicle has an inactivated thruster unit 620*a*. The unmanned underwater vehicle is parallel with the z-axis and has no pitch. In the port thruster operation 600*b*, the unmanned underwater vehicle only activates the port-side thruster of the thruster unit, as shown in thruster unit operation 620*b*. This causes the unmanned underwater vehicle to have a yaw angle of $\phi$ towards the starboard side. The port side thruster also provides sufficient thrust to move the unmanned underwater vehicle a distance of d(z3).

Similarly, in the starboard thruster operation 600*c*, the unmanned underwater vehicle only activates the starboard-side thruster of the thruster unit, as shown in thruster unit operation 620*c*. This causes the unmanned underwater vehicle to have a yaw angle of $-\phi$ towards the port side. The starboard side thruster also provides sufficient thrust to move the unmanned underwater vehicle a distance of d(z4).

In the first and second combined thruster operations 600*d*-1 & 600*d*-2, both thrusters in the thruster unit are activated. In first combined thruster operation 600*d*-1, both thrusters are activated to provide thrust in the same direction, as shown in thruster unit operation 620*d*-1. This causes the unmanned underwater vehicle to move along the z-axis a distance d(z5) due to negating thrusts along the x-axis. In contrast, in the second combined thruster operation 600*d*-2, both thrusters are activated to provide thrust in opposite directions. In this example, the two thrusters are providing equal and opposite amounts of thrust. This causes the unmanned underwater vehicle to have a yaw of $\beta$ while at the same time remaining stationary. The yaw angle $\beta$ during combined thruster operation 600*d*-2 may be greater than the yaw angle $\phi$ of the port thruster operation 600*b* and the starboard thruster operation 600*c*.

Figure 7:
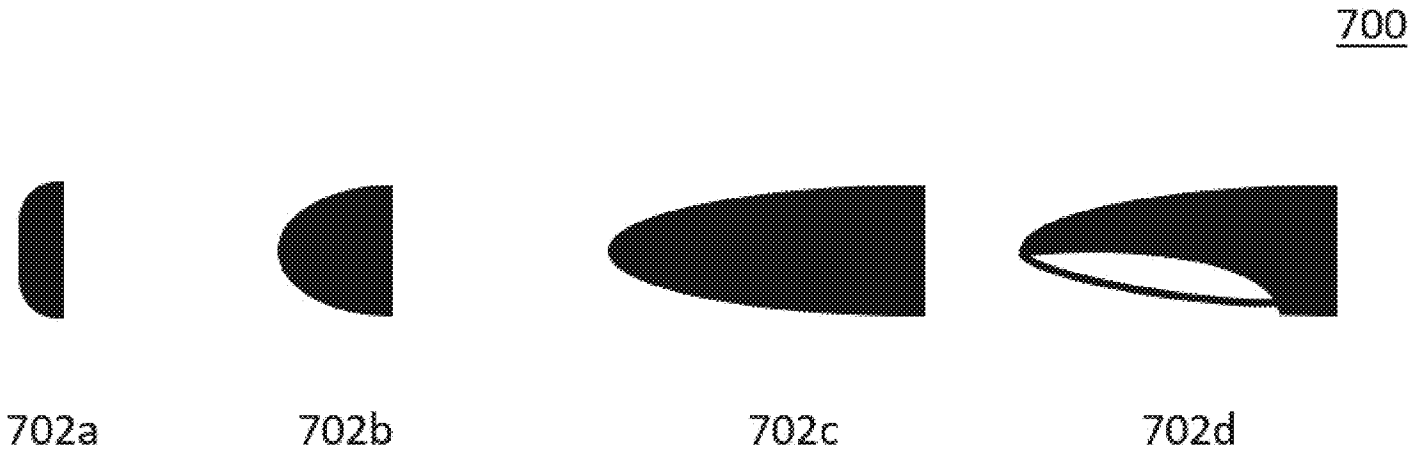
FIG. 7 depicts nose cones of an unmanned underwater vehicle according to various example embodiments.

FIG. 7 depicts nose cones 700 of an unmanned underwater vehicle according to various example embodiments. The first example embodiment nose cone 702*a* has very limited concavity. This example embodiment may use less physical space and is ideal for storage. However, this embodiment may increase drag of the unmanned underwater vehicle while traversing a body of water. The second and third example embodiment nose cones 702*b* and 702*c*, respectively, increase the concavity of the nose cone. The second example embodiment nose cone 702*b* has less concavity than the third example embodiment nose cone 702*c*. The large size of the third example embodiment nose cone 702*c* may facilitate additional payload space for the unmanned underwater vehicle. The fourth example embodiment nose cone 702*d* includes an opening to facilitate use of sensing equipment, such as cameras, sonar, antennae, a global positioning system device, and/or other similar mechanisms. The opening in fourth example embodiment nose cone 702*d* faces down toward the sea bottom. Alternative embodiments may have the opening facing the surface or forward. The opening may be covered by a translucent material, transparent material, or any material that provides greater sensing ability that the body of the unmanned underwater vehicle.

Figure 8:
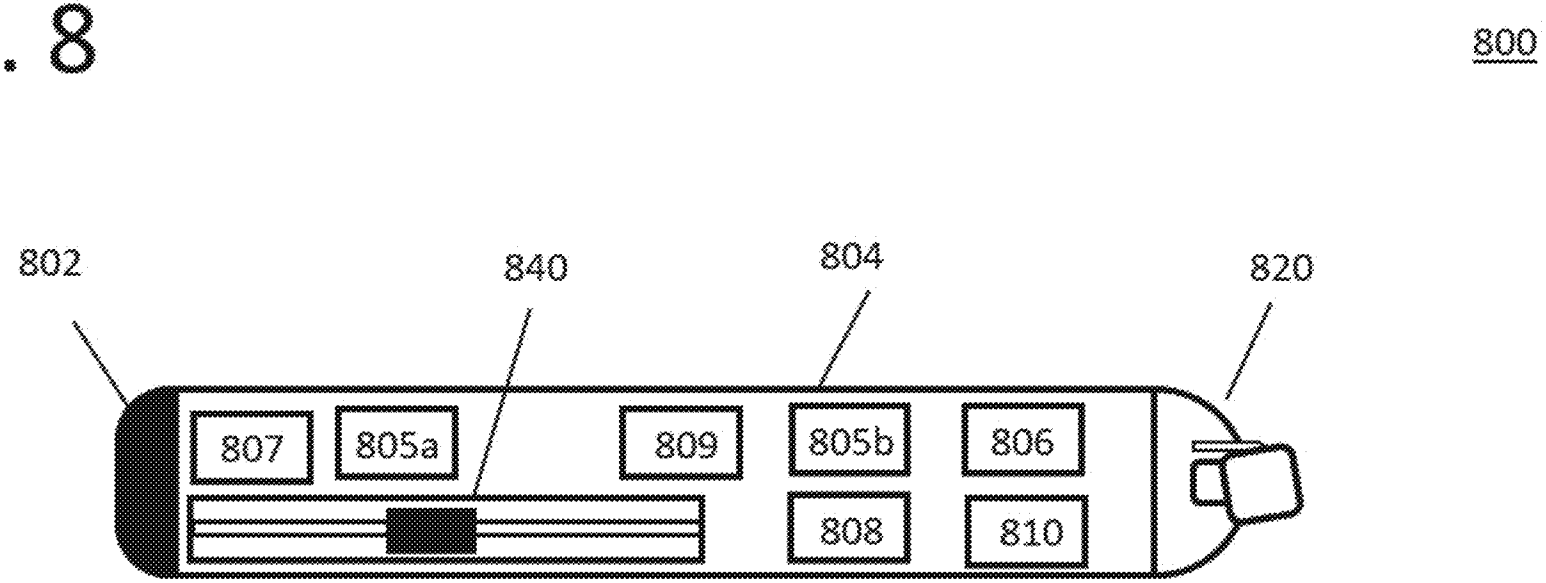
FIG. 8 is an unmanned underwater vehicle according to an example embodiment.

FIG. 8 is an unmanned underwater vehicle 800 according to an example embodiment. The unmanned underwater vehicle 800 is an illustration of various components within the vehicle. As previously mentioned, the unmanned vehicle 800 includes a nose cone 802, a vehicle body 804, and a propulsion system. The propulsion system comprises a movable ballast weight unit 840 and a thruster unit 820.

In addition to these components, the unmanned underwater vehicle 800 may also include sensor units 805*a* and 805*b*. The sensor units 805*a* and 805*b* may include a sonar system, a global positioning system device, a compass, an altimeter, and/or other similar mechanisms. The sensor units may be in different locations of the unmanned underwater vessel. For instance sensor unit 805*a* is closer to the bow, and sensor unit 805*b* is closer to the stern.

Alongside the sensor units 805*a* and 805*b* may be an antenna unit 807 for communicating with vessels, control towers, satellites, and even other unmanned underwater vehicles. The antenna unit 807 may be configured to be positioned in a location within the body of the unmanned underwater vehicle 800 that best facilitates communications. For example, the antenna unit 807 may be located in the fore of the unmanned underwater vehicle 800 in order to facilitate communications with the surface when pitched at a positive angle. In some example embodiments, the antenna unit 807 allows a plurality of underwater vehicle 800 to operate as a swarm.

The unmanned underwater vehicle 800 may also include a power supply unit 806. The power supply unit 806 may be a battery. The battery may be a conventional battery for unmanned vehicles, or may be a system for converting solar or wave energy into power. The power supply unit 806 provides power to all the constituent components of the unmanned underwater vehicle 800.

The power supply unit 810 may be connected to a motor unit 810. The motor unit 810 may be directed connected to a propeller motor shaft in the thruster unit 820.

To control operation of the various units, the unmanned underwater vehicle 800 may also include a controller 809. The controller 809 may be a microprocessor. As an unmanned system, the controller 809 may operate the propulsion system independently of any external controls based on desired parameters. The controller 809 may activate movement of the ballast weight in the movable ballast weight unit 840 in order to control pitch of the unmanned underwater vehicle. The controller 809 may: (i) be preprogramed with algorithms to navigate different conditions; (ii) leverage artificial intelligence or machine learning to navigate unknown conditions; or (iii) a combination thereof. The controller 809 may also activate the thruster unit 820 to control yaw using differential thrust. The controller 809 may also control both the thruster unit 820 and the movable ballast weight unit 840 in tandem to control the attitude of the unmanned underwater vehicle.

Figure 9:
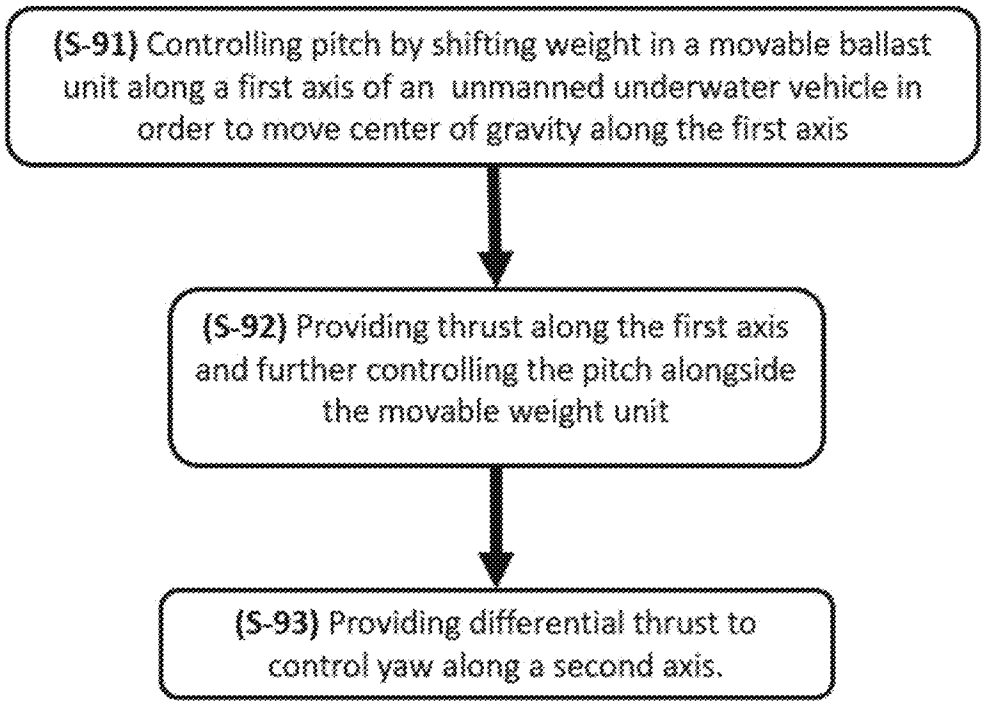
FIG. 9 is a method for propelling underwater according to an example embodiment.

FIG. 9 is a method for propelling underwater 900 according to an example embodiment. The method for propelling underwater 900 may begin with step (S-91) controlling pitch by shifting weight in a movable ballast unit along a first axis of an unmanned underwater vehicle in order to move center of gravity along the first axis. The pitch may take place in the y-z plane. This step may be followed by (S-92) providing thrust along the first axis and further controlling the pitch alongside the movable weight unit. Further to these two steps, a differential thrust may be provided, per step (S-93) to control yaw along a second axis. The yaw may take place in the x-z plane.

The example embodiments being thus described, it will be obvious that the same may be varied in many ways. Such variations are not to be regarded as a departure from the disclosed subject matter, and all such modifications are intended to be included within the scope of the disclosed subject matter.

What is claimed is:

1. A propulsion system comprising:

a movable weight unit comprising a weight within an internal body, the movable weight unit configured to control pitch by shifting the weight along a first axis, which is across a distance of the internal body, in order to move center of gravity along the first axis; and a thruster unit fixed at a non-zero angle relative to the first axis and configured to provide thrust along the first axis and further control the pitch alongside the movable weight unit, wherein the thruster unit is further configured to provide differential thrust to control yaw along a second axis, wherein the thruster unit does not have any appendages and is entirely within the diameter of a vehicle body.

2. The propulsion system of claim 1, wherein the thruster unit comprises a first thruster and a second thruster, each being fixed, angled with respect to azimuth in order to control the yaw, and angled relative to the first axis in order to control the pitch.

3. The propulsion system of claim 2, wherein each of the first thruster and the second thruster comprises:

a propeller configured to provide thrust;

a propeller cover surrounding the propeller;

a propeller motor shaft connected to the propeller and to a motor driving the propeller; and a fixed support preventing movement, wherein the first thruster and the second thruster are connected to a base that is attached to the vehicle body.

4. The propulsion system of claim 2, wherein the first thruster is on a starboard side and the second thruster is on a port side.

5. The propulsion system of claim 4, wherein the first thruster and the second thruster are configured to facilitate the differential thrust through at least, a first operation by activating the first thruster to enable thrust along the first angle and a first yaw angle, a second operation by activating the second thruster to enable thrust along the first angle and a second yaw angle, a third operation by activating the first thruster and the second thruster in a same direction to facilitate thrust along the first angle and a zero or near-zero yaw, and a fourth operation by the first thruster and the second thruster in opposite directions to facilitate zero or near-zero thrust and a third yaw angle.

6. The propulsion system of claim 1, wherein the movable weight unit is a movable ballast unit.

7. The propulsion system of claim 6, the movable ballast unit comprising:

a ballast cavity with a length along the first axis, a ballast weight within the cavity that is configured to move along the length of the cavity, and a ballast screw traversing the cavity and the weight and configured to rotate, wherein rotation of the screw facilitates movement of the ballast weight along the axis with in the ballast cavity and controls the pitch.

8. The propulsion system of claim 7, wherein the movable ballast unit is configured to facilitate pitch changes through at least, a first pitch operation by moving the ballast weight in a forward direction to enable a first pitch angle, a second pitch operation by moving the ballast weight in a forward direction and activating the thruster unit to enable a second pitch angle that is zero or near-zero, a third pitch operation by moving the ballast weight in an aft direction to enable a third pitch angle, and a fourth pitch operation by moving the ballast weight in an aft direction and activating the thruster unit to enable a fourth pitch angle that is greater than the third pitch angle.

9. An underwater apparatus comprising:

a nose cone at a bow of the underwater apparatus;

an apparatus body with a length along a first axis and configured to house a plurality of units;

a propulsion system connected to the apparatus body at a stern of the underwater vehicle and configured to control thrust, pitch, and yaw of the underwater apparatus; and a controller configured to control the propulsion system and the plurality of units, wherein the propulsion system comprises a movable weight unit comprising a weight within an internal body, the movable weight unit configured to control the pitch by shifting the weight along a first axis, which is across a distance of the internal body, in order to move center of gravity along the first axis;

a thruster unit fixed at a non-zero angle relative to the first axis and configured to provide the thrust along the first axis and further control the pitch alongside the movable weight unit, wherein the thruster unit is further configured to provide differential thrust to control the yaw along a second axis, and wherein the thruster unit does not have any appendages and is entirely within the diameter of the underwater apparatus.

10. The underwater apparatus of claim 9, wherein the thruster unit comprises a first thruster and a second thruster, each being fixed, angled with respect to azimuth in order to control the yaw, and angled relative to the first axis in order to control the pitch.

11. The propulsion system of claim 10, wherein each of the first thruster and the second thruster comprises:

a propeller configured to provide thrust;

a propeller cover surrounding the propeller;

a propeller motor shaft connected to the propeller and to a motor driving the propeller; and a fixed support preventing movement, wherein the first thruster and the second thruster are connected to a base that is attached to the apparatus body.

12. The underwater apparatus of claim 9, wherein the movable weight unit is a movable ballast unit.

13. The underwater apparatus of claim 12, the movable ballast unit comprising:

a ballast cavity with a length along the first axis, a ballast weight within the cavity that is configured to move along the length of the cavity, and a ballast screw traversing the cavity and the weight and configured to rotate, wherein rotation of the screw facilitates movement of the ballast weight along the axis within the ballast cavity and controls the pitch.

14. The underwater apparatus of claim 9, wherein the plurality of units includes at least an antenna unit, a power supply unit, at least one sensor unit, and a motor unit.

15. The underwater apparatus of claim 9, wherein the controller is configured to operate the underwater apparatus independently and through the use of computer algorithms, artificial intelligence, machine learning, or a combination thereof.

16. A method for propelling underwater comprising:

controlling pitch of an underwater vehicle by a movable weight unit, the movable weight unit comprising a weight within an internal body, the movable weight unit shifting the weight along a first axis, which is across a distance of the internal body, in order to move center of gravity along the first axis;

providing thrust along the first axis and further controlling the pitch alongside the movable weight unit, and providing differential thrust to control yaw along a second axis, wherein the controlling pitch step, the providing thrust step, and the providing differential thrust step are performed by a thruster unit, the thruster unit lacking appendages and being entirely within the diameter of the underwater vehicle.

* * * * *